US012331743B2

(12) United States Patent
Hauser et al.

(10) Patent No.: US 12,331,743 B2
(45) Date of Patent: Jun. 17, 2025

(54) SCROLL MACHINE WITH MULTIPLE FLOW PATHS FOR THE INLET FLOW INCLUDING IN THE HOLLOW SHAFT PORTION

(71) Applicant: BITZER KUEHLMASCHINENBAU GMBH, Sindelfingen (DE)

(72) Inventors: Markus Hauser, Rottenburg am Neckar-Oberndorf (DE); Christian Scharer, Gaggenau (DE); Thomas Varga, Aildingen (DE)

(73) Assignee: BITZER Kühlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 18/233,201

(22) Filed: Aug. 11, 2023

(65) Prior Publication Data

US 2024/0060491 A1 Feb. 22, 2024

(30) Foreign Application Priority Data

Aug. 16, 2022 (DE) ..... 102022120679.3

(51) Int. Cl.
*F04C 18/02* (2006.01)
*F04C 29/02* (2006.01)
(Continued)

(52) U.S. Cl.
CPC ..... *F04C 18/0215* (2013.01); *F04C 29/02* (2013.01); *F04C 29/04* (2013.01);
(Continued)

(58) Field of Classification Search
CPC ..... F04C 18/0215; F04C 29/02; F04C 29/04; F04C 29/12; F04C 2240/50; F04C 2240/603
See application file for complete search history.

(56) References Cited

U.S. PATENT DOCUMENTS 4,936,756 A * 6/1990 Shimizu ..... F04C 23/008 418/94
2001/0012489 A1* 8/2001 Harakawa ..... F04C 29/045 417/410.5
(Continued)

FOREIGN PATENT DOCUMENTS

DE 3888212 T2 6/1994
DE 10063603 A1 6/2001
(Continued)

OTHER PUBLICATIONS

Partical EPO search report issued Jan. 22, 2024, in pending parallel EP application No. 23181521.8.
(Continued)

*Primary Examiner* — Mary A Davis
(74) *Attorney, Agent, or Firm* — NATH, GOLDBERG & MEYER; Jerald L. Meyer; Ilirian Durri

(57) ABSTRACT

A scroll machine for a medium has a machine housing having a longitudinal axis and an inlet and an outlet for the medium. Provided in the machine housing along the longitudinal axis is: a drive unit having a drive shaft mounted on the machine housing by a first bearing unit and a second bearing unit, a first spiral unit having a spiral channel formed by a first spiral rib and has an inner end region and an outer end region, and a second spiral unit having a spiral channel formed by a second spiral rib and has an inner end region and an outer end region. The first spiral unit and the second spiral unit engage one another to form pressure chambers, wherein the first spiral unit can be moved by means of the drive shaft through the drive unit along an orbital path relative to the second spiral unit.

24 Claims, 5 Drawing Sheets

(51) Int. Cl.
*F04C 29/04* (2006.01)
*F04C 29/12* (2006.01)

(52) U.S. Cl.
CPC ..... *F04C 29/12* (2013.01); *F04C 2240/50* (2013.01); *F04C 2240/603* (2013.01)

(56) References Cited

U.S. PATENT DOCUMENTS

| | | | |
|---|---|---|---|
| 2009/0162222 | A1 | 6/2009 | Iguhi et al. |
| 2011/0129378 | A1 | 6/2011 | Hasegawa et al. |
| 2011/0236242 | A1 | 9/2011 | Su et al. |
| 2014/0090412 | A1 | 4/2014 | Fukasaku et al. |
| 2015/0152731 | A1 | 6/2015 | Yamashita et al. |
| 2018/0066656 | A1 | 3/2018 | Perevozchikov et al. |
| 2020/0080556 | A1 | 3/2020 | Seo et al. |

FOREIGN PATENT DOCUMENTS

| | | | |
|---|---|---|---|
| EP | 3015710 | A1 | 5/2016 |
| KR | 20020055130 | A | 7/2002 |
| WO | 2021/258585 | A1 | 12/2021 |
| WO | 2022/030185 | A1 | 10/2022 |

OTHER PUBLICATIONS

EPO search report issued Mar. 5, 2024, in pending parallel EP application No. 23181521.8.

* cited by examiner

SCROLL MACHINE WITH MULTIPLE FLOW PATHS FOR THE INLET FLOW INCLUDING IN THE HOLLOW SHAFT PORTION

The present invention relates to a scroll machine, in particular a spiral compressor, for a medium, in particular a refrigerant, and to a refrigeration system comprising such a scroll machine.

Scroll machines are fluid energy machines and are already known from the prior art in different designs. Scroll machines include, for example, scroll compressors, spiral compressors, and scroll expanders.

Known scroll machines typically have two interacting spiral units, each having at least one spiral rib forming at least one spiral channel. The spiral ribs of the spiral units engage or mesh with one another to form pressure chambers, the spiral ribs sealingly abutting a spiral channel base of the other spiral unit in question.

Both the spiral channel and the spiral rib forming the spiral channel are in the form of an involute of a circle, with the two spiral units being movable relative to one another. A common design of scroll machine includes a stationary spiral unit and a movable spiral unit, with the movable first spiral unit being moved along an orbital path relative to a second spiral unit.

According to the displacement principle, a medium, for example a refrigerant, is compressed or compacted in a compressor by a relative movement of the two spiral units. During this relative movement, the medium in the pressure chambers is displaced along the spiral channels from an outer end region to an inner end region, with the medium in the pressure chamber undergoing a change in volume.

In an expander, the medium, in particular refrigerant, is expanded by a relative movement of the two spiral units. During this relative movement, the medium in the pressure chambers is displaced along the spiral channels from an inner end region to an outer end region, with the medium in the pressure chamber undergoing an increase in volume.

WO 2018 019 372 A1, for example, discloses a generic scroll machine of the type in question, which can be used in a refrigeration system with a refrigerant circuit. Such refrigeration systems can have a variety of uses, for example cooling a secondary fluid such as air, or cooling components or equipment. The cooling or heating load of refrigeration systems can vary greatly according to ambient conditions, occupancy levels, and other load requirements.

The scroll machines and refrigeration systems described above have proven successful in the past, but it has been shown that the components of the scroll machine require both continuous cooling and lubrication in order to achieve the required service life.

This is where the present invention comes in.

It is the object of the present invention to propose a scroll machine and a refrigeration system of the type described at the outset which eliminate the disadvantages known from the prior art in an expedient manner. A scroll machine and a refrigeration system which are cooled effectively in a simple manner and likewise lubricated are to be provided.

The scroll machine for a medium, in particular a refrigerant, has a machine housing having a longitudinal axis, as well as an inlet and an outlet for the medium. Furthermore, in the scroll machine according to the invention, a drive unit, a drive shaft, a first spiral unit, and a second spiral unit are arranged along the longitudinal axis. The drive shaft is supported on the machine housing by a first bearing unit and a second bearing unit, with the axis of rotation of the drive shaft preferably defining the position and orientation of the longitudinal axis. The first bearing unit and the second bearing unit are preferably arranged in opposite end portions of the drive shaft.

The second bearing unit is arranged in the end portion adjacent to the first spiral unit, and the first bearing unit is arranged in the opposite end portion.

The first spiral unit has a first spiral channel which is formed by a first spiral rib and extends from an inner end region to an outer end region. The second spiral unit has a second spiral channel which is formed by a second spiral rib and extends from an inner end region to an outer end region.

The inlet of the scroll machine is in fluid communication with the outer end regions of the first spiral unit and the second spiral unit; the outer end regions are referred to as the suction region in the context of this invention. The outlet is in fluid communication with the inner end regions, as a result of which the medium is guided through the inlet and through the machine housing along a plurality of flow paths to the outer end regions and from the inner end regions to the outlet.

The first spiral unit can be moved by means of the drive shaft through the drive unit along an orbital path relative to the second spiral unit, and the first spiral unit and the second spiral unit engage one another to form pressure chambers, the spiral ribs sealingly abutting a spiral channel base of the other spiral unit in question.

According to a first embodiment of the present invention, the drive shaft has a hollow shaft portion, one of the flow paths being guided through the hollow shaft portion. The hollow shaft portion is preferably arranged coaxially with the axis of rotation of the drive shaft and can partially or completely penetrate the drive shaft.

The present invention is based on the concept of using the drive shaft simultaneously as a line for the medium, which allows the medium to be guided in a space-saving manner and with low pressure loss within the machine housing and allows the drive shaft and in particular the scroll machine components connected to the drive shaft, such as the bearings of the drive shaft, to be cooled. The proposed solution can provide a particularly compact scroll machine with integrated cooling and efficient lubrication of the bearings.

It is noted at this point that the medium is preferably a refrigerant, the refrigerant comprising a lubricant which can be entrained by the refrigerant.

In a development of the present invention, the hollow shaft portion is formed by a blind hole. The blind hole preferably extends from an end face of the drive shaft in the first end portion toward the second end portion.

According to a further development, the drive shaft can have at least one radial bore, which opens into the hollow shaft portion and connects the hollow shaft portion to an outer lateral surface of the drive shaft. As a result, the medium can be guided along a flow path through the at least one radial bore. The at least one radial bore allows the medium to be conducted out of the drive shaft to individual components in a targeted manner along the longitudinal axis, as a result of which these components can be cooled and/or lubricated by the lubricating medium entrained with the medium.

According to a development, a rotor of the drive unit can be arranged between the first bearing unit and the second bearing unit, the drive shaft between the first bearing unit and the rotor and/or the drive shaft between the second bearing unit and the rotor having the at least one radial bore. At least one radial bore is preferably arranged both between the first bearing unit and the rotor and between the second bearing unit and the rotor. The at least one radial bore between the first bearing unit and the rotor and/or between the second bearing unit and the rotor can contribute to improved cooling of the rotor of the drive unit, the drive shaft preferably having a plurality of radial bores around the circumference, which according to an even more preferred development are arranged circumferentially symmetrically.

In addition, according to a development of the present invention, it has proven to be advantageous for the drive unit or a preferably electric drive around the drive unit to have at least one axial opening and/or at least one axial groove, and for the at least one axial opening and/or the at least an axial groove to define a flow path for the medium. The drive unit preferably has a plurality of axial openings and/or a plurality of axial grooves around the circumference, which are preferably arranged circumferentially symmetrically. The at least one axial opening and/or the at least one axial groove connects opposite end faces of the drive unit or the drive and extensive cooling of the rotor and/or the stator of the drive can be implemented. The at least one axial opening can be formed, for example, by a motor gap and/or the at least one axial groove can be formed by a channel-shaped free space between the stator and the housing. The at least one axial groove and/or axial opening can be formed in the housing and/or the drive unit.

According to a development, it has proven to be advantageous if, between the inlet and the first bearing unit, a flow path is branched into two flow paths connected in parallel, one of the flow paths extending through the hollow shaft portion and the other of the flow paths extending through the first bearing unit. The first bearing unit comprises a secondary bearing body, the secondary bearing body preferably being a roller bearing which is not sealed by seals and through which the other of the flow paths is preferably guided.

Furthermore, the inlet can be arranged in the machine housing directly upstream of the free end of the drive shaft, the inlet even more preferably being arranged approximately coaxially with the drive shaft in the longitudinal axis. The medium coming from the inlet is branched into two flow paths connected in parallel, the medium flowing through the first bearing unit in one path and the hollow shaft portion of the drive shaft in the other. As a result, in particular the secondary bearing body of the first bearing unit can be cooled and, in addition, the lubricant entrained with the medium can lubricate the secondary bearing body.

According to a second embodiment or a development of the present invention, the second bearing unit and the first spiral unit enclose a space, with at least one of the flow paths extending through the second bearing unit into the space.

The second bearing unit can comprise a main bearing body and a main bearing housing. At least one of the flow paths can be guided through the main bearing housing and/or through the main bearing body. In other words, the flow paths can be guided into the space through the second bearing unit exclusively through the main bearing housing or the main bearing body, or in parallel connection through the main bearing housing and the main bearing body.

However, at least one flow path is preferably guided through the main bearing body in order to cool the main bearing body and to lubricate the main bearing body by means of the lubricant entrained with the medium. According to a preferred embodiment, the main bearing body can be an unsealed roller bearing.

According to a preferred embodiment, the second bearing unit separates the machine housing into a drive portion and a suction region, the drive being arranged in the drive portion and the outer end regions of the first spiral unit and the second spiral unit being arranged in the suction region. The inlet opens into an inlet portion, the first bearing unit being arranged between the inlet portion and the drive portion. The medium is guided along the flow paths from the inlet portion through the drive portion and through the second bearing unit to the suction region or the outer end regions of the first spiral unit and the second spiral unit.

According to a development of the present invention, the drive shaft projects into the space through the second bearing unit, and a compensating mass securely connected to the drive shaft, and/or an eccentric drive for the first spiral unit, is/are arranged on the drive shaft in the space. An eccentric drive preferably comprises an eccentric portion which is designed as a driver on the drive shaft and which is coupled to the first spiral unit via an eccentric bearing body. Both the compensating mass and the eccentric drive can move in the space together with the drive shaft, as a result of which the medium present in the space is thoroughly stirred or "hurled around" and the lubricant entrained with the medium can be separated to a considerable extent.

According to a preferred embodiment, the second bearing unit can be cup-shaped or bell-shaped, the main bearing body and an axial bearing for the first spiral unit being provided on opposite sides of the second bearing unit in the longitudinal axis. The main bearing body is preferably arranged in the region of an apex of the bell-shaped second bearing unit and the axial bearing is arranged on the opposite end face.

According to a preferred development of the present invention, at least two flow paths connected in parallel lead from the inlet into the space, one flow path extending through the main bearing body and the other of the flow paths being guided through at least one entry opening formed as a through-hole in the main bearing housing. The two flow paths connected in parallel allow a pressure loss to be reduced while at the same time ensuring sufficient lubrication and/or cooling of the main bearing body.

The main bearing housing preferably has a plurality of entry openings, which are more preferably distributed symmetrically around the circumference. The entry openings are preferably arranged in a lateral surface of the main bearing housing, where, even more preferably, they are arranged in the longitudinal axis approximately centrally between the opposite sides of the second bearing unit.

According to a development of the present invention, the space has at least one exit opening and the exit opening defines a flow path which connects the space to the outer end regions of the first spiral unit and the second spiral unit or to the suction region.

Furthermore, it has proven to be advantageous for the at least one exit opening to comprise a first bore portion and a second bore portion, and for the first bore portion and the second bore portion to be arranged in an L or T shape. The first bore portion and the second bore portion are preferably formed along respective straight lines, which intersect at a common point of intersection. Even more preferably, with respect to the longitudinal axis the first bore portion is oriented in a radial direction and the second bore portion is oriented in an axial direction. The first bore portion is preferably designed as a through-bore and connects an outer lateral surface of the main bearing housing to the space. The second bore portion can be formed, for example, by a blind hole. Alternatively, at least one of the two bore portions can be formed in the main bearing housing by a primary shaping or reshaping process.

When the scroll machine is used as intended, an exit opening can preferably be arranged in such a way that lubricant can drain out of the space through the exit opening. For this purpose, in particular, an exit opening is arranged in an underside of the second bearing unit. Separated lubricant can accumulate in the region of the underside, where it can be entrained or drained by the flow through the exit opening.

In a further embodiment of the present invention, the at least one exit opening can be formed by an axial cut-out which extends from radially outside to radially inside and interrupts the axial bearing surface. The at least one axial cut-out is traversed when the first spiral unit moves along the orbital path, as a result of which the axial bearing can be continuously lubricated and cooled. The transition between the surface of the axial bearing and the at least one radially oriented axial cut-out can be provided with transition radii.

According to a development, an axial bearing element is arranged between the second bearing unit and the first spiral unit and is preferably arranged on the axial cut-outs which extend from radially outside to radially inside and interrupt the axial bearing surface. The axial bearing element can preferably be an axial bearing plate.

Furthermore, it has proven to be advantageous for the at least one exit opening to be formed by a line in the second bearing unit, the line preferably comprising a first bore portion and a second bore portion, which are arranged in an L-shape. The first bore portion is preferably arranged in a radially oriented manner and the second bore portion is arranged in an axially oriented manner. The first bore portion and the second bore portion can preferably be incorporated into the second bearing unit or the main bearing housing, the first bore portion preferably penetrating the second bearing unit completely, while the second bore portion can be formed as a blind hole. The first bore portion consequently extends from the space to an outer lateral surface of the second bearing unit or the main bearing housing, where it is preferably closed by the machine housing or a machine housing portion. The second bore portion intersects the first bore portion and opens out in the outer end regions of the first spiral unit and the second spiral unit or in the suction region of the two spiral units.

According to a preferred development of the present invention, the at least one exit opening is, in relation to the longitudinal axis, circumferentially offset from the at least one entry opening in the space. Arranging the entry openings so as to be offset from the exit opening allows the medium to remain in the space for longer, as a result of which it is possible to increase the separation rate of the lubricant entrained in the medium in the space.

According to a preferred development of the present invention, the at least one exit opening, on the side of the second bearing unit facing the first spiral unit, is arranged partially or completely within a surface which is traversed by the first spiral unit when said unit moves completely along the orbital path. The at least one exit opening is thus partially or completely traversed at least once when the first spiral unit moves completely along the orbital path, as a result of which the axial bearing arranged between the second bearing unit and the first spiral unit can be lubricated.

In addition, it has proven to be advantageous for the first spiral unit to have, on the side facing the at least one exit opening, a recessed portion which is situated within a surface which traverses the at least one exit opening when the first spiral unit moves completely along the orbital path. The recessed portion prevents the first spiral unit from coming into direct contact with the at least one exit opening, which means that damage to the exit opening and/or to a surface of the axial bearing of the first spiral unit can be avoided.

According to a development of the present invention, at least one ring-pin coupling is provided, which prevents a complete rotation of the first spiral unit about the longitudinal axis. Such a ring-pin coupling comprises at least one ring-pin coupling pair, preferably a plurality of ring-pin coupling pairs, each having a pin that engages a corresponding abutment. In the annular abutment, the pin can perform a movement corresponding to the orbital path.

One of the flow paths is preferably guided through the ring-pin coupling, and even more preferably the abutment is formed in the second bearing unit and either perforates the second bearing unit completely or has a connecting bore which perforates the second bearing unit so that the flow path coming from the inlet can be guided through the abutment. The lubricant entrained by the refrigerant can collect in the ring-pin coupling for lubrication.

The at least one connecting bore can guide a flow path coming from the inlet through the second bearing unit to the suction region. The connecting bore does not necessarily have to be guided through a pair of ring-pin couplings or through the abutment thereof, as described above, but can also be guided beyond the pair of ring-pin couplings through the second bearing unit.

When the scroll machine is used as intended, the at least one pair of ring-pin couplings is arranged in such a way that lubricant can flow out of the drive portion through the ring-pin coupling toward the suction region. For this purpose, in particular, a ring-pin coupling is arranged in the region of an underside of the second bearing unit.

According to a development of the present invention, the second spiral unit is stationary. The second spiral unit should therefore preferably not move relative to the first spiral unit and the machine housing when the scroll machine is being operated as intended.

According to a development or according to a further aspect of the present invention, a high-pressure chamber can be arranged in the housing. The inner end regions of the first spiral unit and the second spiral unit are connected to the high-pressure chamber via a passage, and the medium from the high-pressure chamber can leave the machine housing through the outlet.

The high-pressure chamber can be connected to an outlet via a pressure connection piece. The pressure connection piece can be arranged, in a plane transverse to the longitudinal axis, offset with respect to the passage and can more preferably be arranged in the pressure chamber along the longitudinal axis on the side opposite the passage. The offset arrangement between the passage and the pressure connection piece is intended to ensure that pressure pulsations are reduced and that the medium coming out of the passage cannot flow out of the scroll machine directly through the pressure connection piece.

In the high-pressure chamber a back-flow region can be provided which forces an S-shaped flow path from the passage to the outlet. The back-flow region facilitates dampening of pulsations and reduces pressure fluctuations in the medium discharged through the outlet.

According to a development, an intermediate bottom can be provided between the high-pressure chamber and the second spiral unit, the intermediate bottom together with the machine housing enclosing the high-pressure chamber. The intermediate bottom absorbs a large portion of the pressure load of the high-pressure chamber, as a result of which the second spiral unit is subjected to lower loads.

It has also proven to be advantageous for the back-flow region to be formed by a recess formed in the intermediate bottom on the side facing the high-pressure chamber and by the pressure connection piece, the pressure connection piece oriented toward the recess projecting into the high-pressure chamber.

Furthermore, it has proven to be advantageous for the pressure connection piece to be in active contact with the intermediate bottom in a contact region to form the flow region, and for the contact region, on an imaginary connecting line, to be arranged between the pressure connection piece and the passage in a plane perpendicular to the longitudinal axis.

According to a development, a non-return valve can be provided, which is arranged between the high-pressure chamber and the outlet. The non-return valve can be arranged both in the outlet and in the pressure connection piece, the non-return valve particularly preferably being inserted into the pressure connection piece in the form of a bushing. This results in a particularly compact and simple design.

A further aspect of the present invention relates to a refrigeration system comprising a scroll machine as described above.

Two exemplary embodiments of the present invention are described in detail below with reference to the accompanying figures, in which.

Identical or functionally identical parts or features are identified with the same reference signs in the following detailed description of the figures. In addition, not all identical or functionally identical components are provided with a reference number in the figures.

Figure 1:
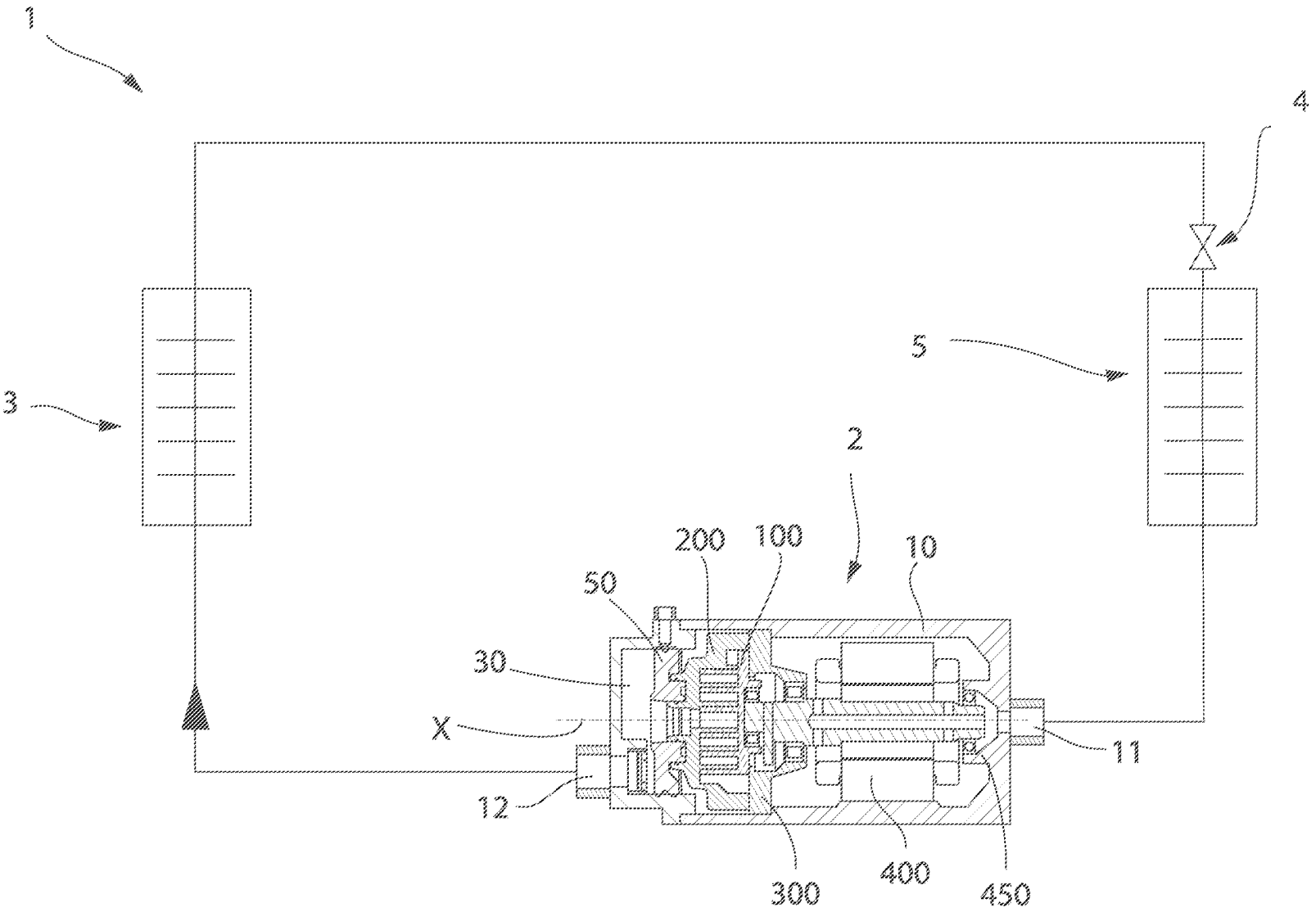
FIG. 1 is a highly simplified and schematic representation of a refrigeration system comprising a scroll machine according to the invention.

FIG. 1 shows a preferred embodiment of a refrigeration system 1 comprising a scroll machine 2. The refrigeration system 1 comprises the scroll machine 2 designed as a scroll compressor, a condenser 3, an expansion element 4, and an evaporator 5. A medium, preferably a refrigerant, flows through the refrigeration system 1 in the direction indicated by arrows, first from an outlet 12 of the scroll machine 2 then, in sequence, to the condenser 3, the expansion element 4, the evaporator 5, and finally back through an inlet 11 into the scroll machine 2.

A preferred embodiment of the scroll machine 2 shown in FIG. 1 is described below with reference to FIGS. 2 to 5.

Figure 2:
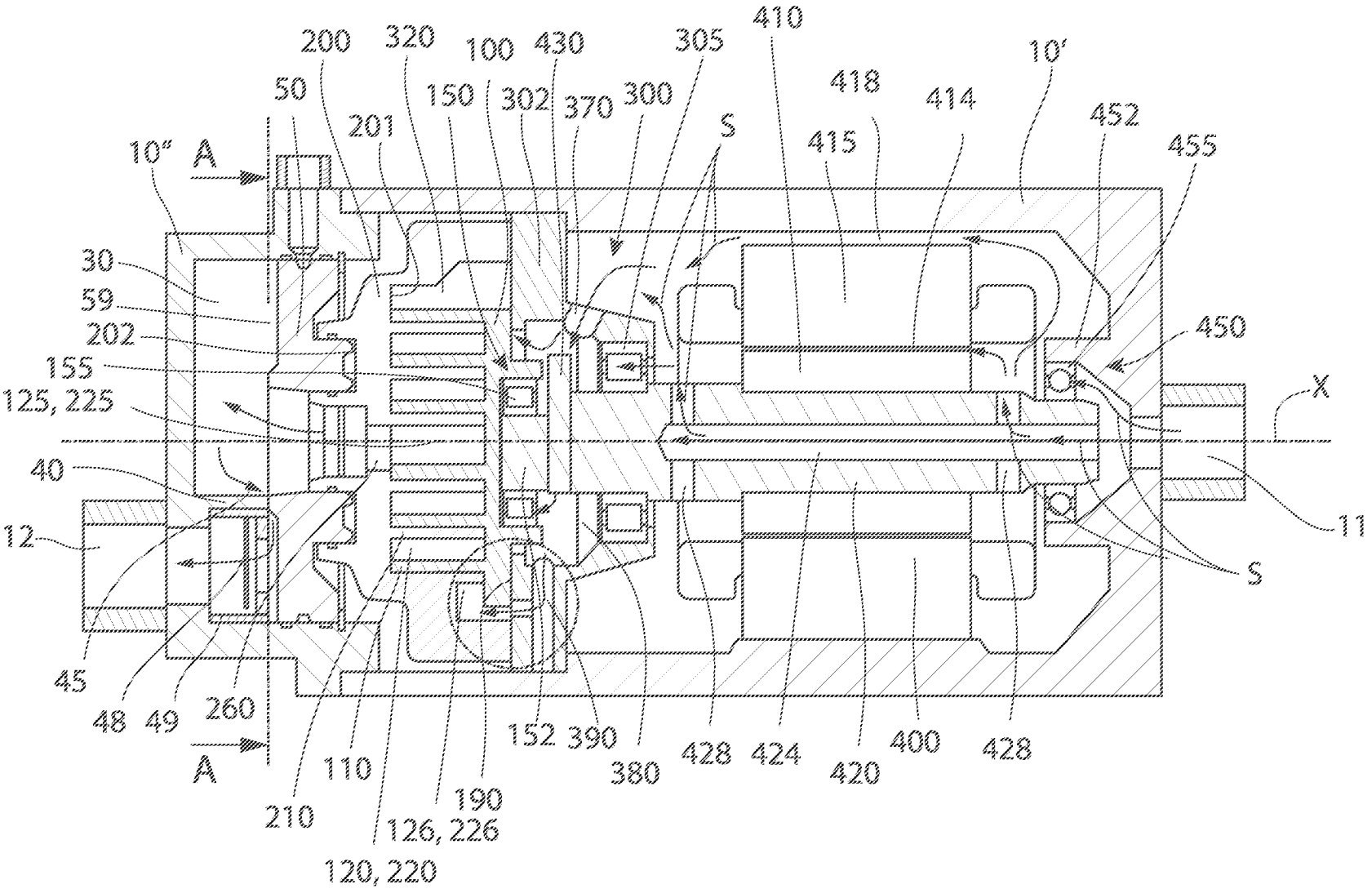
FIG. 2 is an enlarged, simplified sectional view of a first exemplary embodiment of the scroll machine according to FIG. 1.

FIG. 2 is a simplified sectional view of the scroll machine 2 according to FIG. 1. The scroll machine 2 has a machine housing 10, which is designated as a whole and oriented along a longitudinal axis X. The machine housing 10 can have a plurality of housing parts, the machine housing 10 having a first housing part 10' and a second housing part 10" in the present exemplary embodiment.

From right to left, the inlet 11, a drive unit 400, a drive shaft 420, a first spiral unit 100, a second spiral unit 200, an intermediate bottom 50, a high-pressure chamber 30, and the outlet 12 are arranged in the machine housing 10 along the longitudinal axis X according to FIG. 2.

The first spiral unit 100 is coupled to the drive unit 400 via an eccentric drive 150 and the drive shaft 420.

The drive unit 400 preferably comprises an electric drive having a rotor 410 and a stator 415, the rotor 410 being rigidly coupled to the drive shaft 420.

The drive shaft 420 is oriented in the longitudinal axis X and the axis of rotation of the drive shaft 420 defines the longitudinal axis X in the exemplary embodiment shown. The drive shaft 420 has a first end portion and a second end portion on opposite sides in the longitudinal axis X.

In the first end portion, the drive shaft 420 is supported on the machine housing 10 by a first bearing unit 450 and in the second end portion by a second bearing unit 300. The rotor 410 of the drive unit 400 is arranged between the first bearing unit 450 and the second bearing unit 300.

The drive shaft 420 has a hollow shaft portion 424 which is oriented in the longitudinal X axis. The hollow shaft portion 424 can be designed as a blind hole and extends from a free end face of the drive shaft 420 in the first end portion toward the second end portion.

The drive shaft 420 also comprises a plurality of radial bores 428 which perforate the drive shaft 420 and connect the hollow shaft portion 424 to an outer lateral surface of the drive shaft 420.

According to FIG. 2, the drive shaft 420 can have at least one radial bore 428 between the first bearing unit 450 and the rotor 410 and/or between the second bearing unit 300 and the rotor 410. In the preferred embodiment shown, the drive shaft 420 has two radial bores 428 between the first bearing unit 450 and the rotor 410 and two radial bores 428 between the second bearing unit 300 and the rotor 410, which bores are arranged circumferentially symmetrically with respect to the drive shaft 420.

The first bearing unit 450 comprises a bearing holder 452 and a secondary bearing body 455. The bearing holder 452 can be formed by the machine housing 10. The secondary bearing body 455 can be designed as a roller bearing, which is preferably not sealed.

The first bearing unit 450 divides an interior of the machine housing 10 into an inlet portion and a drive portion, the inlet 11 opening into the inlet portion.

The inlet 11 is preferably arranged on an end face of the machine housing 10, with the inlet 11 even more preferably being arranged in alignment with the drive shaft 420—preferably directly—upstream of the free end face of the drive shaft 420.

The second bearing unit 300 comprises a main bearing housing 302 and a main bearing body 305. The main bearing body 305 can be designed as a preferably unsealed roller bearing. The second bearing unit 300 further separates the interior of the machine housing 10 into the drive portion and a suction region 320.

The second bearing unit 300 has a first side and a second side, the first side being nearest the drive unit 400 and the second side being nearest the first spiral unit 100. The main bearing body 305 is arranged on the first side and an end face on the second side forms an axial bearing 190 for the first spiral unit 100.

The second bearing unit 300 or the main bearing housing 302 can be bell-shaped or cup-shaped and enclose a space 380 together with the first spiral unit 100.

Figure 5:
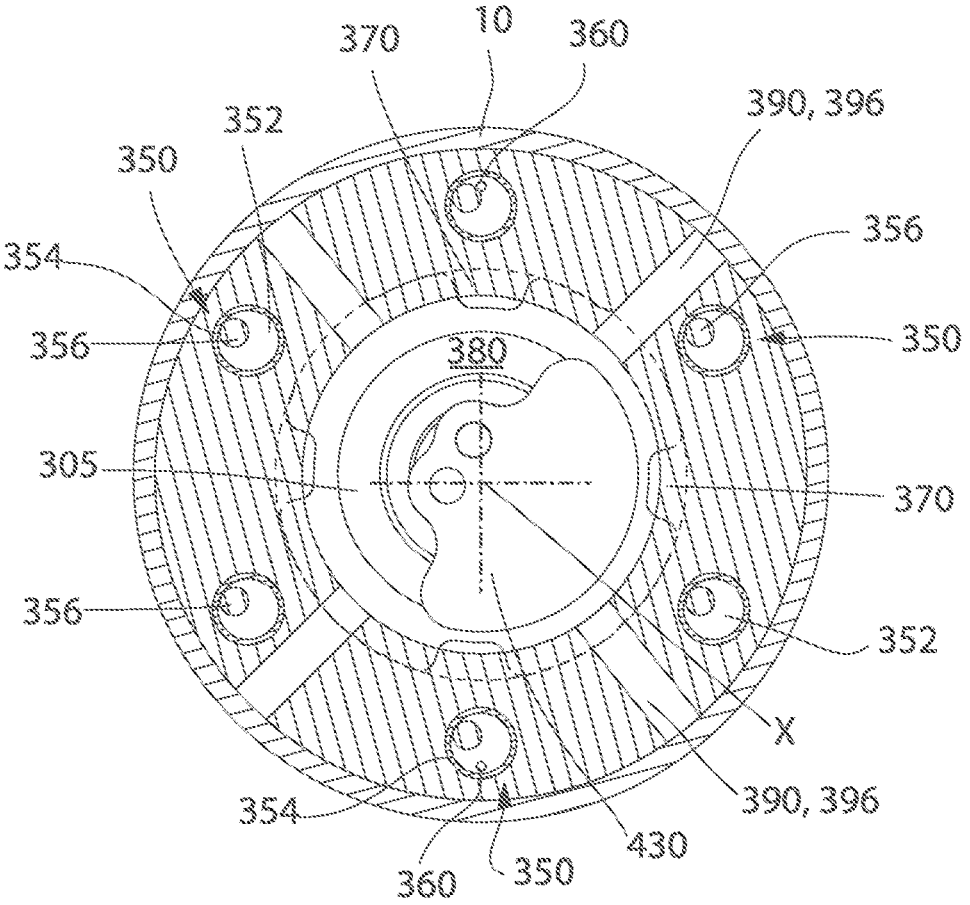
FIG. 5 is a sectional view of the scroll machine along the section line B-B in FIG. 4.

The space 380 has a plurality of entry openings 370 which are arranged in the second bearing unit 300 or in the main bearing housing 302. The entry openings 370 perforate the main bearing housing 302 and open into the space 380. For example, the second bearing unit 300 can have four entry openings 370, which, as shown in FIG. 5, can be arranged circumferentially symmetrically on a lateral surface, preferably approximately centrally between the first side and the second side.

Figure 3:
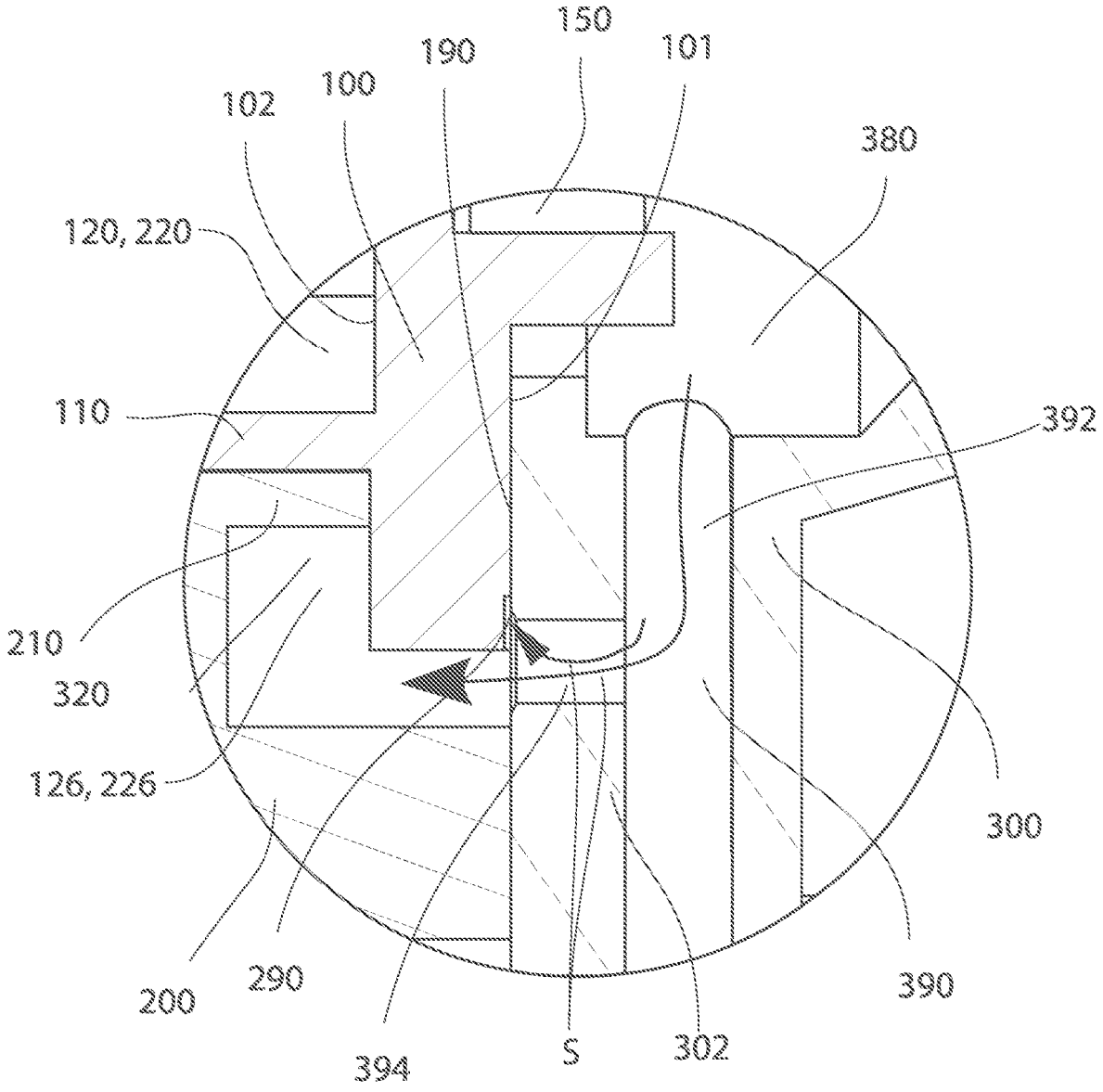
FIG. 3 is an enlarged detailed view of the scroll machine according to FIG. 2.

Furthermore, the space 380 can have a plurality of exit openings 390 which are preferably situated in the second bearing unit 300 or the main bearing housing 302. FIG. 3 shows an enlarged detailed view as shown in FIG. 2, from which it can be seen that the exit opening 390 can be formed from a first bore portion 392 and a second bore portion 394 in the main bearing housing 302.

The first bore portion 392 is oriented substantially radially and extends from the space 380. For manufacturing reasons, it can be advantageous for the first bore portion 392 to penetrate the main bearing housing 302 completely.

The second bore portion 394 is oriented substantially axially and connects the second side of the second bearing unit 300 or the main bearing housing 302 to the first bore portion 392.

The second bearing unit 300 can have four exit openings 390, which are preferably arranged circumferentially symmetrically. Furthermore, the exit openings 390 can be offset in the circumferential direction relative to the entry openings 370—as indicated in FIG. 5.

With further reference to FIG. 2, it can be seen that the drive shaft 420 projects into the space 380 through the second bearing unit 300 or through the main bearing body 305. A compensating mass 430 arranged on the drive shaft 420 is located in the space 380.

Furthermore, it can be seen from FIG. 2 that the eccentric drive 150 is arranged in the space 380 and comprises an eccentric shaft portion 152 and an eccentric bearing body 155 arranged on the eccentric shaft portion 152. The eccentric shaft portion 152 can be formed by the drive shaft 420.

The first spiral unit 100 according to FIG. 2 has a first side 101 and has a second side 102 which is opposite the first side 101 in the longitudinal axis X. On the first side 101, the first spiral unit 100 is supported on the second bearing unit 300 by means of the axial bearing 190. The eccentric drive 150 is coupled to the first spiral unit 100 on the first side 101 and, on the second side 102, a first spiral rib 110 is arranged which protrudes along the longitudinal axis X and forms a first spiral channel 120.

Figure 4:
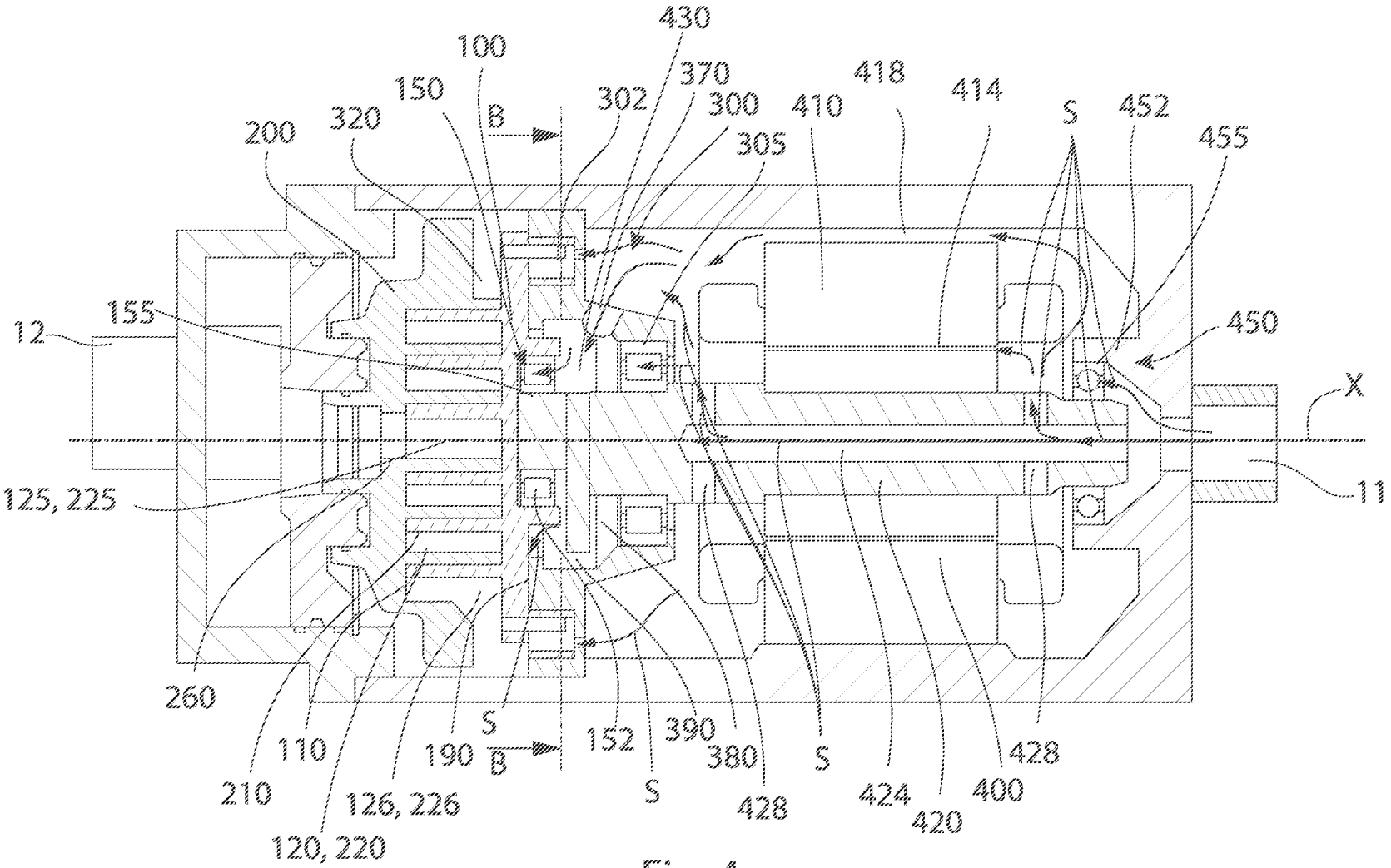
FIG. 4 is an enlarged, simplified sectional view of the scroll machine according to FIG. 1.

A ring-pin coupling 350 is also provided, which comprises a plurality of ring-pin coupling pairs 351 (see FIG. 4 or 5). The ring-pin coupling pairs form the ring-pin coupling 350 which prevents full rotation of the first spiral unit 100 about the longitudinal axis X. The ring-pin coupling 350 couples the first spiral unit 100 to the second bearing unit 300 and comprises a pin 356 and comprises an abutment which can be formed by a recess 352 and a sleeve 354 situated in the recess 352. In the abutment, the pin 356 can perform a movement corresponding to the orbital path.

According to the embodiment shown, the abutment can be formed in the second bearing unit 300 and the pins 356 protrude from the first side 101 of the first spiral unit 100 and engage the abutment of the second bearing unit 300. A ring-pin coupling pair 351 can have a connecting bore 360 which perforates the second bearing unit 300 or the main bearing housing 302.

It can also be seen from FIG. 2 that the first spiral rib 110 on the second side 102 of the first spiral unit 100 forms the spiral channel 120 with a spiral channel base. At the end face, the spiral rib 110 also has a first spiral rib tip, which can either have a seal or be designed as a flat tip. Furthermore, the first spiral channel 120 can have an inner end region 125 and/or an outer end region 126.

The first spiral rib 110 is involute-shaped and extends from the inner end region 125 to the outer end region 126. The inner end region 125 is located radially on the inside relative to the longitudinal axis X and the outer end region 126 is located radially on the outside relative to the longitudinal axis X. The at least one spiral channel 120 is U-shaped and is delimited in the radial directions by the spiral rib 110 or a spiral wall of the spiral rib 110 and by the spiral channel base.

The second spiral unit 200 can be stationary and has a first side 201 and has a second side 202 which is opposite the first side 201 in the longitudinal axis X. A second spiral rib 210 protrudes in the longitudinal axis X on the first side 201, the second spiral rib 210 forming a second spiral channel 220.

At the end face, the second spiral rib 210 also has a second spiral rib tip, which can either have a seal or be designed as a flat tip. Furthermore, the second spiral channel 220 can have an inner end region 225 and/or an outer end region 226.

The second spiral rib 210 is adapted to the first spiral rib 110 and is also involute-shaped and extends from the inner end region 225 to an outer end region 226. The inner end region 225 is located radially on the inside relative to the longitudinal axis X and the outer end region 226 is located radially on the outside relative to the longitudinal axis X. The at least one second spiral channel 220 is U-shaped and is delimited in the radial directions by the second spiral rib 210 or a spiral wall of the second spiral rib 210 and by the second spiral channel base.

As shown in FIG. 2, the first spiral rib 110 of the first spiral unit 100 and the second spiral rib 210 of the second spiral unit 200 engage or mesh with one another. The first spiral unit 100 can be moved through the drive unit 400 along an orbital path (not shown) relative to the second spiral unit 200. A ring-pin coupling 350 prevents the first spiral unit 100 from rotating about the longitudinal axis X while moving along the orbital path.

Upon engaging or meshing with one another, the first spiral rib 110 engages the second spiral channel 220 and the second spiral rib 210 engages the first spiral channel 120. The second spiral rib tip of the second spiral rib 210 sealingly interacts with the spiral channel base of the first spiral unit 100 and the first spiral rib tip of the first spiral rib 110 interacts with the spiral channel base of the second spiral unit 200.

In a compressor, as the first spiral unit 100 moves along the orbital path between the first spiral unit 100 and the second spiral unit 200, pressure chambers (not shown) are enclosed through which medium is transported from the outer end regions 126, 226 to the inner end regions 125, 225. The outer end regions 126, 226 together form the suction region 320, from which the medium can be sucked into the spiral channels 120, 220 in order to then be transported in closed pressure chambers (not shown) from the outer end region 126, 226 to the inner end region 125, 225, the pressure chambers undergoing a continuous reduction in volume.

In an expander, as the first spiral unit 100 moves along the orbital path between the first spiral unit 100 and the second spiral unit 200, pressure chambers (not shown) are enclosed which transport medium from the inner end regions 125, 225 to the outer end regions 126, 226. During this process, the pressure chambers undergo a continuous increase in volume.

The medium is guided in the machine housing 10 along a plurality of flow paths from the inlet 11 to the outer end regions 126, 226, the medium being used along these flow paths to cool the components in the machine housing 10 and/or to lubricate them by means of entrained lubricant. In FIGS. 2-5, the flow paths are indicated by arrow lines; for better understanding only some of the arrow lines are marked with the reference sign "S".

The medium enters the machine housing 10 through the inlet 11 into the inlet portion. The medium then flows from the inlet portion into the drive portion.

In the inlet portion, the medium branches and flows along two flow paths connected in parallel toward the drive portion, one of the flow paths extending through the first bearing unit 550 and the other flow path being guided through the drive shaft 420 or through the hollow shaft portion 424 of the drive shaft 420.

The medium can flow from the hollow shaft portion 424 into the drive portion through the radial bore 428 of the drive shaft 420. The drive shaft 420 can have one or more radial bores 428 both between the first bearing unit 450 and the rotor 410 and between the rotor 410 and the second bearing unit 300, as a result of which the flow path guided through the hollow shaft portion 424 branches several times and is used for cooling and/or lubrication, for example, of the rotor 410, the first bearing unit 300 and/or the second bearing unit 450.

Furthermore, it can be seen from FIG. 2 that the drive unit 400 has at least one axial opening 414 and/or at least one axial groove 418, which each guide a flow path through the drive unit 400. Each axial opening 414 and each axial groove 418 connects the two opposite end faces of the drive device 400, as a result of which the drive unit 400 is "flushed" with the medium. Very effective cooling of the drive unit 400 can be realized by this measure.

The at least one axial opening 414 can be formed by a passing gap between the rotor 410 and the stator 415.

From the drive portion, the medium then flows along a plurality of flow paths through the second bearing unit 300 into the suction region 320.

The medium can be guided via the space 380 to the suction region 320 and can be guided via the connecting bore 360 in the ring-pin coupling 350 or in the at least one ring-pin coupling pair 351.

The medium can be guided from the inlet 11 into the space 380 along two flow paths connected in parallel, one of the flow paths extending through the entry openings 370 and the other of the flow paths extending through the main bearing body 305. In this way, the main bearing body 305 can be both cooled and lubricated by the lubricant entrained with the medium.

In the space 380, the medium flows around the compensating mass 430 and the eccentric drive 150 of the first spiral unit 100, as a result of which these components can be both cooled and lubricated.

The medium can leave the space 380—as can be seen from the enlarged view according to FIGS. 3 and 5—through the exit openings 390, which connect the space 380 to the suction region 320 or to the outer end regions 126, 226 of the first spiral unit 100 and the second spiral unit 200. The exit openings 390 open into the suction region 320 on the second side of the second bearing unit 300, which side faces the first spiral unit 100, each exit opening 390 preferably opening within a surface that is fully or partially traversed by the first spiral unit 100 when said unit moves completely along the orbital path. The positions at which the exit openings 390 open allow the first side of the first spiral unit 100 or the axial bearing 190 to be lubricated by the lubricant entrained by the medium.

In order to avoid damage to the exit opening 390 and/or the axial bearing surface of the first spiral unit 100, the first spiral unit 100—as shown in FIG. 3—can have, on the side facing the at least one exit opening 390, a recessed portion 290 which is arranged within a surface which traverses the at least one exit opening 390 during a complete movement along the orbital path. In this way the exit opening 390 and the first spiral unit 100 do not come into contact.

A flow path can be guided from the drive portion and the suction region 320 through the ring-pin coupling 350 or the ring-pin coupling pairs 351. Each ring-pin coupling pair 351 can have a connecting bore 360 (see FIG. 5) which guides a further flow path coming from the inlet 11 to the suction region 320. For this purpose, the connecting bores 360 perforate the second bearing unit 300 and connect the first side of the second bearing unit 300 to the recess 352 in the first spiral unit 100. The pressure drop of the medium can be reduced by the connecting bores 360 in the ring-pin coupling pairs 351.

According to a development (not shown), at least one connecting bore 360 can be provided which perforates the second bearing unit 300 between two ring-pin coupling pairs 351 and guides a flow path from the inlet 11 to the suction region 320.

According to a development (not shown), the exit openings 390 can be formed by a plurality of radially oriented axial cut-outs arranged in the second side of the second bearing unit 300.

The axial cut-outs can extend over the second side of the second bearing unit 300 and thus also over the axial bearing 190 formed between the second bearing unit 300 and the first spiral unit 100. The lubricant entrained in the medium can contribute to lubricating the axial bearing 190 when the first spiral unit 100 traverses the recessed regions.

Furthermore, this development can comprise an axial bearing element which can be arranged in the form of a plate between the second bearing unit 300 and the first spiral unit 100. The axial bearing element is preferably an axial bearing plate.

In the two exemplary embodiments described above, the high-pressure chamber 30 and the intermediate bottom 50 are arranged on the second side 202 of the second spiral unit 200, the intermediate bottom 50 being arranged along the longitudinal axis X between the high-pressure chamber 30 and the second spiral unit 200. The intermediate bottom 50 decouples the second spiral unit 200 from the pressure forces in the high-pressure chamber 30 and is supported with respect to the machine housing 10.

The high-pressure chamber 30 is connected to the second spiral channel 220 via a passage 260, the passage 260 comprising an outlet opening which is arranged in the region of the inner end regions 125, 225. The outlet opening, also known as the "discharge port", is preferably formed in the inner end region 225 of the second spiral channel base and the passage 260 extends along the longitudinal axis X through a through-hole through the intermediate bottom 50 to the high-pressure chamber 30.

The high-pressure chamber 30 is in turn connected to the outlet 12 and the medium can leave the scroll machine 2 through the outlet 12.

The high-pressure chamber 30 is surrounded or housed by the machine housing 10 and the intermediate bottom 50 and has the outlet 12 through which the medium can leave the scroll machine. For this purpose, the machine housing 10 or the second housing part 10" can be cup-shaped and have a recess, it being possible for the intermediate bottom 50 to close the high-pressure chamber 30 in the machine housing 10 or the second housing portion 10" in the manner of a cover or plug. For this purpose, the shapes of the recess in the second housing portion 10" and in the intermediate bottom 50 are adapted to one another, with both the recess and the intermediate bottom 50 preferably having a circular-cylindrical shape and being able to fit together precisely.

In order to avoid leakage between the intermediate bottom 50 and the machine housing 10, sealing means can be provided there.

The intermediate bottom 50 has a first side and a second side, the first side being nearest the second spiral unit 200 and the second side being nearest the high-pressure chamber 30. The intermediate bottom 50 comprises the through-hole through which the passage 260 extends.

In the embodiment shown, the intermediate bottom 50 has an annular projection protruding on the first side of the intermediate bottom 50 in the longitudinal axis X from the first side of the intermediate bottom 50 toward the second spiral unit 200.

On the first side of the intermediate bottom 50, there can be an axial securing means in the form of a securing ring which is fastened in the machine housing 10 and by means of which the position of the intermediate bottom 50 in the longitudinal axis X is determined. The axial securing means supports the intermediate bottom 50 on the side of the machine housing 10 facing the second spiral unit 200, as a result of which the pressure forces from the high-pressure chamber 30 are substantially decoupled from the second spiral unit 200 and coupled into the machine housing 10.

The second spiral unit 200 can telescopically embrace the annular projection of the intermediate bottom 50 and for this purpose has, on the second side 202, a first annular projection and a second annular projection, the first annular projection interacting with an inner lateral surface of the annular projection and the second annular projection interacting with an outer lateral surface of the annular projection of the intermediate bottom 50.

The annular projection of the intermediate bottom 50 and the annular projections embracing the annular projection of the intermediate bottom 50, on the second side 202 of the second spiral unit 200, do not necessarily have to be provided, but rather represent a preferred development that can be used in particular when the scroll machine 1 has an injection system or an eco-port.

The annular projections of the intermediate bottom 50 and the annular projections of the second spiral unit 200 can form a radial bearing for the second spiral unit 200.

As shown by the arrows in FIG. 2, the medium can reach the outlet 12 from the high-pressure chamber 30 via a pressure connection piece 40, the pressure connection piece 40 preferably being arranged in such a way that the medium cannot flow directly from the passage 260 into the pressure connection piece 40.

The pressure connection piece 40 projects from the side of the machine housing 10 facing the intermediate bottom 50, in the direction of the intermediate bottom 50 and, as shown in FIG. 7, is offset from the passage 260 in a plane perpendicular to the longitudinal axis X.

In order to bring about a particularly effective reduction of pressure fluctuations in the high-pressure chamber 30, a back-flow region 45 can be provided, which forces an S-shaped flow path S from the passage 260 through the pressure connection piece 40 to the outlet 12, which is indicated in FIG. 2 by an arrow line.

Figure 6:
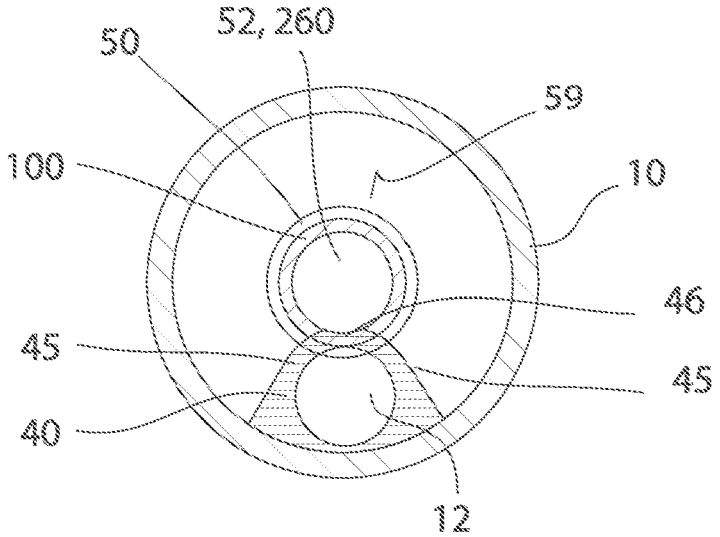
FIG. 6 is a sectional view of the scroll machine along section line A-A in FIG. 2.

The back-flow region 45 can have, on the second side of the intermediate bottom 50 facing the high-pressure chamber 30, a preferably annular recess 59 (see FIG. 6) which together with the pressure connection piece defines the S-shaped flow path. For this purpose, the pressure connection piece 40 is in operative contact in a contact region 46 with the intermediate bottom 50 as shown in FIG. 6, the contact region 46, on an imaginary connecting line, being located between the pressure connection piece 40 and the passage 260 in a plane perpendicular to the longitudinal axis X. As a result, the medium coming from the passage 260 must first be deflected in order to flow into the recess 59 and from the recess to reach the outlet 12 through the pressure connection piece 40.

A non-return valve 48 shown in FIG. 2 can be arranged between the high-pressure chamber 30 and the outlet 12 and preferably comprises a bushing 49 that can be inserted into the pressure connection piece 40.

LIST OF REFERENCE NUMERALS

1 Refrigeration system
2 Scroll machine
3 Condenser
4 Expansion element
5 Evaporator
10 Machine housing
11 Inlet
12 Outlet
30 High-pressure chamber
40 Pressure connection piece
45 Back-flow region
46 Contact region
49 Bushing
50 Intermediate bottom
100 First spiral unit
101 First side
102 Second side
110 First spiral rib
120 First spiral channel
125 Inner end region
126 Outer end region
150 Eccentric drive
152 Eccentric shaft portion
155 Eccentric bearing body
190 Axial bearing
200 Second spiral unit
201 First side
202 Second side
210 Second spiral rib
225 Inner end region
226 Outer end region
220 Second spiral channel
260 Passage
290 Recessed portion
320 Suction region
300 Second bearing unit
302 Main bearing housing
305 Main bearing body
350 Ring-pin coupling
351 Ring-pin coupling pair
352 Recess
354 Sleeve
356 Bolts
360 Connecting bore
370 Entry opening
380 Space
390 Exit opening
392 First bore portion
394 Second bore portion

400 Drive unit
410 Rotor
414 Axial groove
415 Stator
418 Axial opening
420 Drive shaft
424 Hollow shaft portion
428 Radial bore
430 Compensating mass
450 First bearing unit
452 Bearing holder
455 Secondary bearing body

The invention claimed is:

1. A scroll machine (2) for a medium, comprising:

a machine housing (10) having a longitudinal axis (X) and an inlet and an outlet for the medium, wherein, provided in the machine housing (10) along the longitudinal axis (X) is a drive unit (400) having a drive shaft (420) which is mounted on the machine housing (10) by a first bearing unit (450) and a second bearing unit (300);

a first spiral unit (100) having a spiral channel (120) which is formed by a first spiral rib (110) and has an inner end region (125) and an outer end region (126), the first spiral unit (100) being provided in the machine housing (10); and a second spiral unit (200) having a spiral channel (220) which is formed by a second spiral rib (210) and has an inner end region (225) and an outer end region (226), wherein the first spiral unit (100) and the second spiral unit (200) engage one another to form pressure chambers, and wherein the second spiral unit (200) is provided in the machine housing (10), wherein the first spiral unit (100) is movable by means of the drive shaft (420) through the drive unit (400) along an orbital path relative to the second spiral unit (200), wherein an inlet (11) is in fluid communication with the outer end regions (126, 226) of the first and second spiral units (100, 200) and an outlet (12) is in fluid communication with the inner end regions (125, 225) of the first and second spiral units (100, 200), wherein the medium in the machine housing (10) flows along a plurality of flow paths from the inlet (11) to the outer end regions (126, 226) of the first and second spiral units (100, 200), and the drive shaft (420) has a hollow shaft portion (424) through which one of the flow paths extends, wherein a high-pressure chamber (30) is arranged in the machine housing (10), the inner end regions (125, 225) of the first and second spiral units (100, 200) being connected to the high-pressure chamber (30) via a passage (260), the inner end regions (125, 225) of the first and second spiral units (100, 200) being further connected to the outlet (12) via the high-pressure chamber (30), wherein the high-pressure chamber (30) is connected to the outlet (12) by a pressure connection piece, wherein the pressure connection piece is arranged in a plane transverse to the longitudinal axis (X) and is offset with respect to the passage (260), wherein the high-pressure chamber (30) includes a back-flow region (45) which forces an S-shaped flow path in the high-pressure chamber (30), and characterized in that an intermediate bottom (50) is provided between the high-pressure chamber (30) and the second spiral unit (200) and in that the back-flow region (45) is formed by a recess (59) formed in the intermediate bottom (50) on the side facing the high-pressure chamber (30) and by the pressure connection piece (40) projecting toward the recess (59).

2. The scroll machine (2) according to claim 1, characterized in that the hollow shaft portion (424) is formed by a blind hole, and in that the drive shaft (420) has at least one radial bore (428) which perforates the drive shaft (420) from the hollow shaft portion (424).

3. The scroll machine (2) according to claim 1, characterized in that a rotor (410) of the drive unit (400) is arranged between the first bearing unit (450) and the second bearing unit (300), and in that the drive shaft (420) has the at least one radial bore (428) between the first bearing unit (450) and the rotor (410) and/or between the second bearing unit (300) and the rotor (410).

4. The scroll machine (2) according to claim 3, characterized in that the drive unit (400) has at least one axial opening (414) and/or at least one axial groove (418), and in that the at least one axial opening (414) and/or the at least one axial groove (418) defines one of the flow paths.

5. The scroll machine (2) according to claim 1, characterized in that between inlet (11) and drive shaft (420) a flow path branches into two flow paths connected in parallel, one of the flow paths extending through the hollow shaft portion (424) and the other of the flow paths being guided through the first bearing unit (450).

6. The scroll machine (2) according to the preamble of claim 1, characterized in that the second bearing unit (300) and the first spiral unit (100) enclose a space (380) and in that at least one of the flow paths leads through the space (380).

7. The scroll machine (2) according to claim 6, characterized in that at least two flow paths coming from the inlet (11) lead through the second bearing unit (300) into the space (380), one of the flow paths extending through the main bearing body (305) and the other of the flow paths being guided through at least one entry opening (370) formed as a through-hole in the main bearing housing (302).

8. The scroll machine (2) according to claim 7, wherein the at least one entry opening (370) comprises a plurality of entry openings (370), the plurality of entry openings (370) being circumferentially arrayed.

9. The scroll machine (2) according to claim 8, wherein the plurality of entry openings (370) are symmetrically arrayed.

10. The scroll machine (2) according to claim 6, characterized in that the drive shaft (420) projects into the space (380) and has a compensating mass (430) and/or an eccentric drive (150) in the space (380).

11. The scroll machine (2) according to claim 6, characterized in that the space (390) has at least one exit opening (390), and in that the exit opening (390) defines a flow path which connects the space (380) to the outer end regions (126, 226).

12. The scroll machine (2) according to claim 11, characterized in that the at least one exit opening (390) is provided as a radially oriented axial cut-out on the side facing the first spiral unit (100).

13. The scroll machine (2) according to claim 11, characterized in that the at least one exit opening (390) has a radially oriented first bore portion (392) and an axially oriented second bore portion (394).

14. The scroll machine (2) according to claim 11, characterized in that the at least one exit opening (390) is offset in the circumferential direction with respect to the at least one entry opening (370).

15. The scroll machine (2) according to claim 11, characterized in that the at least one exit opening (390), on the side facing the first spiral unit (100), opens partially or completely within a surface which is traversed when the first spiral unit (100) moves completely along the orbital path.

16. The scroll machine (2) according to claim 11, characterized in that the first spiral unit (100) has, on the side facing the at least one exit opening (390), a recessed portion (290) which is arranged within a surface and traverses the at least one exit opening (390) during a complete movement along the orbital path.

17. The scroll machine (2) according to claim 1, characterized in that the second bearing unit (300) comprises a main bearing housing (302) and a main bearing body (305), and in that at least one of the flow paths extends through the main bearing housing (302) and/or the main bearing body (305).

18. The scroll machine (2) according to claim 1, characterized in that a ring-pin coupling (350) is provided, and in that one of the flow paths is guided through the ring-pin coupling (350).

19. The scroll machine (2) according to claim 1, characterized in that the second spiral unit (200) is stationary.

20. The scroll machine (2) according to claim 1, characterized in that the pressure connection piece (40) is in operative contact with the intermediate bottom (50) in a contact region (46) to form the back-flow region (45), and in that the contact region (46), on an imaginary connecting line, is arranged between the pressure connection piece (40) and the passage (260) in a plane perpendicular to the longitudinal axis (X).

21. The scroll machine (2) according to claim 1, characterized in that the pressure connection piece (40) comprises a bushing (49) with a non-return valve.

22. A refrigeration system (1) comprising a scroll machine (2) according to claim 1.

23. The scroll machine (2) according to claim 1, wherein the scroll machine (2) comprises a spiral compressor.

24. The scroll machine (2) according to claim 1, wherein the medium comprises a refrigerant.

* * * * *